US008313299B2

(12) United States Patent
Kupferberg

(10) Patent No.: US 8,313,299 B2
(45) Date of Patent: Nov. 20, 2012

(54) FRUSTOCONICAL CENTRIFUGAL WHEEL

(76) Inventor: Minel Kupferberg, Hampstead (CA)

( * ) Notice: Subject to any disclaimer, the term of this patent is extended or adjusted under 35 U.S.C. 154(b) by 1202 days.

(21) Appl. No.: 12/149,630

(22) Filed: May 6, 2008

(65) Prior Publication Data

US 2009/0280013 A1 Nov. 12, 2009

(51) Int. Cl.
*F04D 29/28* (2006.01)

(52) U.S. Cl. ..... 416/186 R; 416/202

(58) Field of Classification Search ..... 416/186 R, 416/202

See application file for complete search history.

(56) References Cited

U.S. PATENT DOCUMENTS

| | | | | |
|---|---|---|---|---|
| 32,409 | A | | 5/1861 | Caldwell |
| 1,049,181 | A | | 12/1912 | Wallin |
| 2,065,865 | A | | 12/1936 | Methvin |
| 2,484,554 | A | | 10/1949 | Concordia et al. |
| 3,145,911 | A | | 8/1964 | Helmbold |
| 3,292,364 | A | | 12/1966 | Cazier |
| 3,584,968 | A | * | 6/1971 | Keith ..... 415/210.1 |
| 3,811,978 | A | * | 5/1974 | Wooden ..... 156/160 |
| 5,171,128 | A | | 12/1992 | Williamson et al. |
| 5,314,310 | A | | 5/1994 | Bachellier |
| 5,810,557 | A | * | 9/1998 | Akinkuotu et al. ..... 415/206 |
| 6,042,335 | A | | 3/2000 | Amr |
| 7,210,907 | B2 | | 5/2007 | Patti |
| 8,007,240 | B2 | * | 8/2011 | Sanagi et al. ..... 416/186 R |

* cited by examiner

*Primary Examiner* — Ninh H Nguyen
(74) *Attorney, Agent, or Firm* — Welsh Flaxman & Gitler LLC

(57) ABSTRACT

An inline centrifugal wheel has a back plate and a hub extending from the back plate. A front plate has a diameter greater than the back plate and is inclined to extend downwardly from a central aperture to its outer perimeter. Blades extend between the back and front plate and have an outer edge extending between the outer edges of the front and back plate. The blades extend tangentially to the central aperture of the front plate.

6 Claims, 2 Drawing Sheets

FRUSTOCONICAL CENTRIFUGAL WHEEL

BACKGROUND OF THE INVENTION

Ventilation systems for buildings use fans and blowers to move air from the building when needed. The fans or blowers must move thousands of cubic feet of air in an efficient, quiet manner. Typical types of fans are centrifugal fans and axial fans.

Centrifugal wheels are well known in the art and have a circular front plate and a back plate with a series of blades extending between the two plates. Air enters the centrifugal wheel through the front plate and is moved radially outwardly due to the rotation of the blades. Conventional centrifugal wheels have front plates and back plates with the same diameter, giving the wheel a cylindrical shape.

When centrifugal blowers, or wheels, are used in axial fans, the wheel moves the air radially outwardly. A problem arises when the wheel is in close proximity to the housing. This problem is addressed in U.S. Pat. No. 5,810,557 (Akinkuotu) and is illustrated in FIG. 1 of that patent. Akinkuotu addresses this problem by using fan blades that are angled relative to the longitudinal axis of the wheel. This results in the air moving in a radial and axial direction, as shown in FIGS. 5 and 7.

U.S. Pat. No. 5,171,128, to Williamson et al., discloses a wheel with cut outs 80 formed in the back plate and between the blades. This gives the back plate a saw tooth appearance, as seen in FIG. 3. U.S. Pat. No. 6,042,335, to Amr, discloses a centrifugal wheel with a hub 15 and blades 13 extending beyond the edge of the hub as best seen in FIG. 1.

It is an object of the invention to provide a centrifugal wheel having a frustoconical shape.

It is another object of the invention to provide a centrifugal wheel having a front plate with a greater diameter than the back plate.

It is another object of the invention to provide a centrifugal wheel which efficiently moves air.

It is yet another object of the invention to provide a centrifugal wheel used in a ventilation stack to move large amounts of air from a building.

These and other objects of the invention would be apparent to one of ordinary skill in the art after reading the disclosure of the invention.

SUMMARY OF THE INVENTION

A centrifugal wheel has a back plate and a hub extending from the back plate. A front plate has a diameter greater than the back plate and is inclined to extend downwardly from a central aperture to its outer perimeter. Blades extend between the back and front plate and have an outer edge extending between the outer edges of the front and back plate. The blades extend tangentially to the central aperture of the front plate.

DETAILED DESCRIPTION OF THE INVENTION

Figure 1:
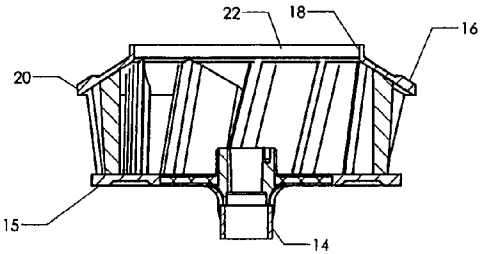
FIG. 1 is a cross-sectional side view of the centrifugal wheel.

The wheel 10, as seen in FIG. 1, has a back plate 12 with a depending hub 14 and an outer edge 15. Spaced from the back plate is a front plate 16. The front plate has a central aperture defining an inner edge 18. The front plate extends downwardly as it extends radially outwardly to the outer edge 20. A plurality of blades 22 extends between the front and back plate. As can be seen in the figures, the outer edge 24 of each of the blades 22 extends between the outer edge of the back plate and the outer edge of the front plate.

Figure 2:
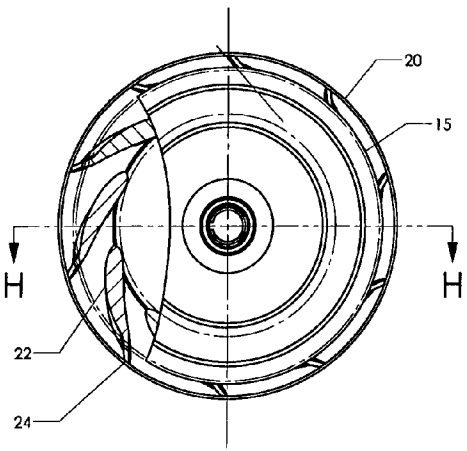
FIG. 2 is a bottom view of the wheel with a portion of the back plate removed to reveal the blades.

FIG. 2 shows the bottom view of the centrifugal wheel. In this view, the fan would rotate clockwise so that the leading edge is closer to the center. The outer edge 20 of the front plate 16 extends beyond the outer edge 15 of the back plate 12. The blades have an airfoil cross section, as seen by the cut away portion. Also, as seen in the figure, blades 22 extend tangentially from the inner edge 18 of the front plate outwardly to the outer edges of the front and back plates. The blades are set at an angles, such as 45 degrees from the radial direction. This is known as backwardly inclined. The blades could be radially extending.

Figure 3:
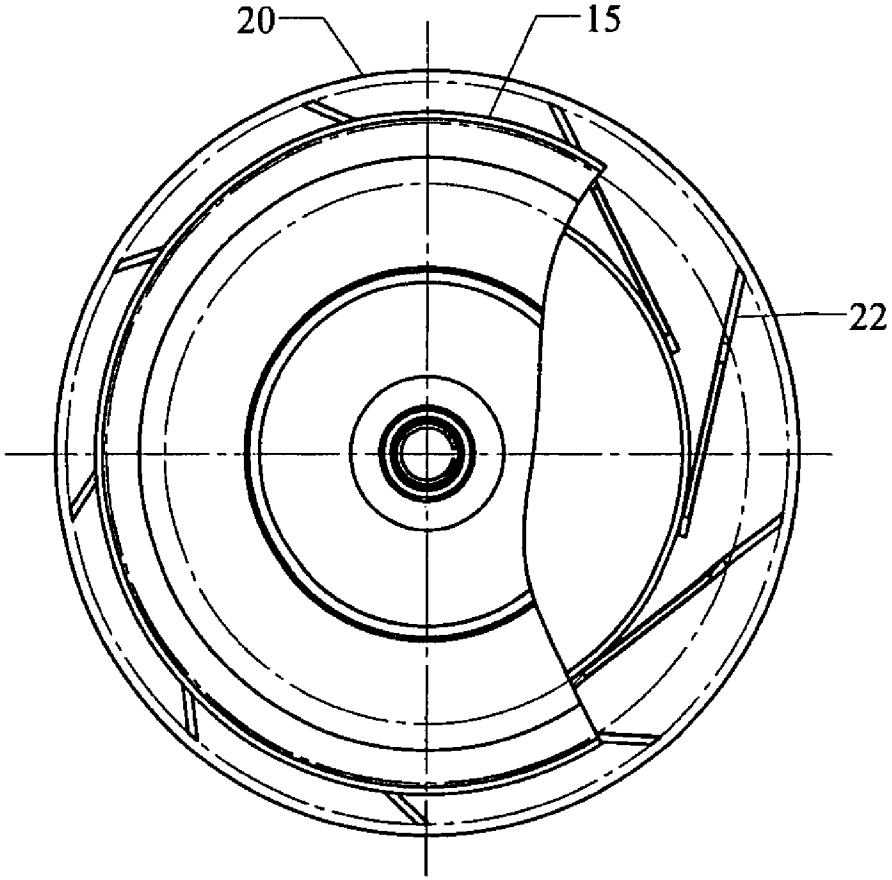
FIG. 3 is a bottom view of a second embodiment of a wheel having flat blades backward inclined, with a portion of the back plate removed to reveal the blades.

An alternative embodiment of the wheel is seen in FIG. 3. In this embodiment, the blades 122 have a flat cross section, as is seen by the cut away portion of the back plate. All other aspects of the wheel remain the same.

Air entering the centrifugal wheel through the central aperture is moved radially outwardly by the blades 22. The smaller diameter of the back plate, relative to the front plate, allows air moved by the blades to extend away from the front plate, in the longitudinal direction. This is particularly useful when the centrifugal wheel is used in a ventilation stack.

While the invention has been described with reference to a preferred embodiment, and variations and modifications would be apparent to one of ordinary skill in the art, the invention encompasses such variations and modifications.

I claim:

1. A centrifugal wheel comprising a planar back plate lying in a single plane and including a hub portion, and an outer edge, the back plate including a depending central hub extending downwardly from the plane in which the black plate lies;

a front plate spaced from the back plate, the front plate includes a central aperture defining an inner edge of the front plate and an outer edge radially spaced from the inner edge, the front plate also includes a frustoconical central body extending between the inner edge and the outer edge, the central body extending downwardly at a constant angular orientation as it extends radially outwardly from the inner edge to the outer edge;

a longitudinal axis extending through the front and back plates and through the depending central hub;

a plurality of blades extending between the front and back plates and attached to the hub portion, each blade having an outer edge, the blade outer edge inclined relative to the longitudinal axis, wherein a diameter of the front plate along the outer edge of the front plate is greater than a diameter of the back plate along the outer edge of the back plate allowing air moved by the plurality of blades to extend away from the front plate in the longitudinal direction extending from the front plate to the back plate.

2. The wheel of claim 1, wherein the outer edge of each blade extends from the outer edge of the front plate to the outer edge of the back plate.

3. The wheel of claim 1, wherein the blades have an air foil cross section.

4. The wheel of claim 1, wherein the blades have a constant cross section.

5. The wheel of claim 1, wherein the blades are set at a 45 degree angle from the longitudinal direction.

6. The wheel of claim 1, wherein the blades are backwardly inclined and set at a 45 degree angle from the longitudinal direction.

* * * * *